US007461930B2

(12) United States Patent
Rosa

(10) Patent No.: US 7,461,930 B2
(45) Date of Patent: Dec. 9, 2008

(54) SEAL FOR INKJET ORIFICES

(75) Inventor: Dell T. Rosa, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 324 days.

(21) Appl. No.: 11/082,353

(22) Filed: Mar. 17, 2005

(65) Prior Publication Data

US 2006/0209144 A1 Sep. 21, 2006

(51) Int. Cl.
*B41J 2/175* (2006.01)
*B41J 2/165* (2006.01)

(52) U.S. Cl. ..... 347/86; 347/29; 347/31

(58) Field of Classification Search ..... 347/29, 347/87, 31; 206/1.9, 441, 701, 722
See application file for complete search history.

(56) References Cited

U.S. PATENT DOCUMENTS 5,400,060 A 3/1995 Carlotta
5,414,454 A 5/1995 Reid
5,648,802 A 7/1997 Abe
5,850,238 A 12/1998 Karita et al.
5,917,514 A 6/1999 Higuma et al.
6,074,037 A 6/2000 Nakahara et al.
6,097,407 A 8/2000 Terasawa et al.
6,578,947 B1 * 6/2003 Suwabe et al. ..... 347/29
6,588,875 B1 * 7/2003 Kleinhammer ..... 347/29
6,634,732 B2 10/2003 Farr et al.

FOREIGN PATENT DOCUMENTS

JP 06000962 A * 1/1994
JP 2004216913 A * 8/2004

* cited by examiner

*Primary Examiner*—Matthew Luu
*Assistant Examiner*—Lisa M Solomon
(74) *Attorney, Agent, or Firm*—Luedeka, Neely & Graham, PC

(57) ABSTRACT

An absorbent material is employed as a seal over the printhead nozzles. The absorbent is uni-axial to prevent ink migration laterally, implemented by a lattice of absorbent matter surrounded by ink barriers. Such an absorbent can be sufficiently effective to limit ink migration that a simple tape may be used to bind the absorbent over the orifices of an inkjet cartridge in the manner of a common bandage. The barriers at a minimum a located to surround and keep separate inks of different colors.

8 Claims, 1 Drawing Sheet

SEAL FOR INKJET ORIFICES

TECHNICAL FIELD

This invention relates to inkjet printing and particularly to an effective seal over the orifices of inkjet printing cartridges.

BACKGROUND OF THE INVENTION

Inkjet cartridges are typically sealed with adhesive tape over the ink orifices to prevent ink evaporation, ink leakage, and contamination from getting into the nozzle holes. The adhesive of the adhesive tape tends to swell and soften when in contact with ink. The swollen softer adhesive can and does flow into the nozzle holes of the ink cartridge and occludes them, thereby preventing ejection of ink from the print head. This represents a challenge to engineer an adequate solution for both sealing the nozzle holes and not occluding them. All pressure sensitive adhesive based adhesive systems are reasonably expected to suffer from this same defect.

Most manufacturers have addressed this problem primarily through two approaches. First is to use a thermoplastic adhesive that has adherent properties when hot, and plastic properties when cool. The thermoplastic is heated just long enough to adhere the film to the nozzle plate and seal the nozzle holes, the thermoplastic promptly cools, freezing the material in place. In this form thermoplastic adhesives are significantly less susceptible to swelling, softening and flowing upon contact with ink. The second method involves a mechanical seal. A mechanical seal is usually composed of an elastomeric component that can be physically squeezed against the nozzle plate surface to seal the nozzle holes. Several variations of these are known in the art.

Other known options are to use a separate cap of some kind instead of a tape or the like directly over the orifices. Such options are prone to ink leakage because of poor sealing, with consequent ink migration over the printhead. This is unacceptable to the customer.

With ongoing progress in inkjet printing, the nozzle holes are smaller. Smaller holes are more subject to being clogged. Direct application of tape on the nozzles entails some entry of tape material into the nozzle orifices, such as by initial pressure or by creep over time because of heat or chemical action of the ink. In the small orifices especially, the entered material is prone to breaking off and clogging the orifice.

Use of an absorbent pad over the orifices is shown as prior art in U.S. Pat. No. 5,648,802 to Abe, but this does not appear in other known solutions. Yet a pad which does not enter the orifices and which prevents spread of the ink would solve both of the problems of clogging and containment of the ink.

DISCLOSURE OF THE INVENTION

This invention employs an absorbent material as a seal over the printhead nozzles that is uni-axial absorbent to prevent ink migration laterally. This may be implemented by a lattice of absorbent matter surrounded by ink barriers. Such an absorbent can be sufficiently effective to limit ink migration that a simple tape may be used to bind the absorbent over the orifices of an inkjet cartridge in the manner of a common bandage which combines tape with a center pad.

The surface area of the regions of absorbent matter may depend on the objective. Where multicolored inks are in the printhead, barriers minimally are located to separate nozzles of different colors. Where it is an objective to have minimum ink around each nozzle, the surface area of the absorbent regions would be materially less than the area of each orifice.

To foster containment of the ink, the barrier material may not only be impermeable to ink, but also effective to limit ink movement because of other characteristics, such a selected stiffness, which limit ink flow under the barrier.

BRIEF DESCRIPTION OF THE DRAWINGS

The details of this invention will be described in connection with the accompanying drawings, in which.

DESCRIPTION OF PREFERRED EMBODIMENTS

Figure 1:
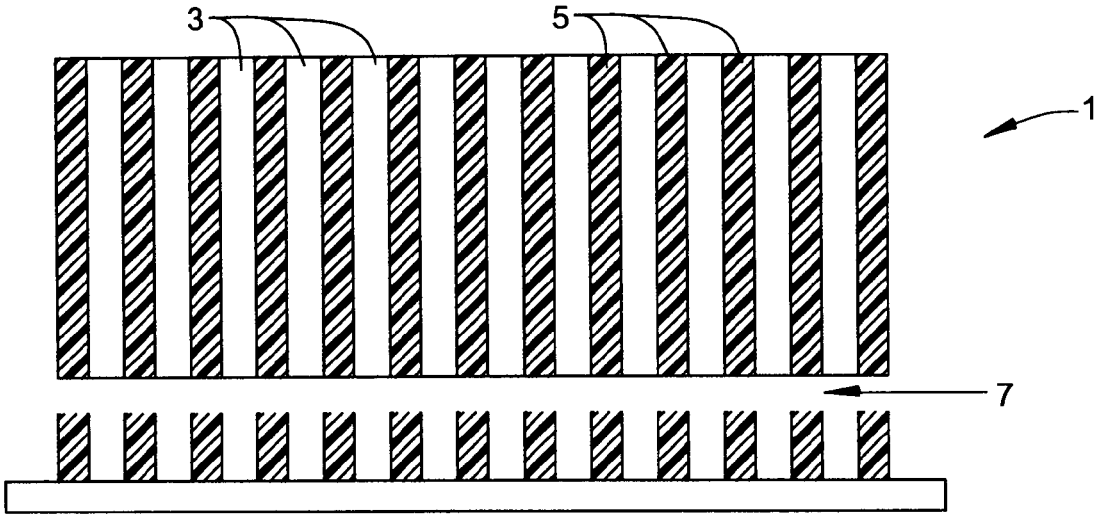
FIG. 1 is illustrative of the structure of an absorbed element of this invention.

As shown in FIG. 1 an absorbent pad 1 is designed with capillaries perpendicular to the surface which will be applied to a nozzle plate. These capillaries allow for absorption and movement of ink along only one axis, away from or toward the nozzle plate.

Regions of absorbent material 3 are separated by barrier layers 5. This blocks lateral transfer of material in each of the absorbent regions 3 to other regions. A barrier layer 5 also surrounds the entire pad.

Depending on the details of design of pad 1, some ink may move through the contact interface between the nozzle plate and the pad 1. It is believed, however, that much less ink will intermix or escape the pad. Moreover, it is believed that certain design alternatives can virtually eliminate ink movement out of or around each absorbent region under normal conditions of storage and movement.

The barrier layer may be made robust in its ability to seal against the nozzle plate by being of only moderately resilient material or by being repellant to the ink or both. The number of absorbent regions over a given area can be increased, thereby increasing the number of barrier regions that moving ink would encounter.

The absorbent material may be a material similar to foam, felt, cotton batting, or a gel such as a hydrophilic superabsorbent gel, and other absorbent materials known in the art. The absorbent material is a natural material or is engineered to have aligned capillaries that permit fluid transport along only the axis perpendicular to the nozzle plate. Other angles from 5 degrees to 90 degrees are acceptable, however 90 degrees is most preferred.

The absorbent material especially, should be free from migratable species that could induce flocculation in the ink. Such species would include polyvalent metal ions, organic cations, and acidic species. The absorbent material may have non-migratable functionality that will flocculate ink held within the absorbent. This local flocculation could be desired to prevent lateral movement of the pigment and hence prevent color cross contamination.

The purpose of the absorbent layer is to trap any ink that escapes the nozzles and prevent that ink from moving elsewhere on the body of the print head. A secondary purpose of the absorbent layer is to trap ink that escapes the nozzles and prevent it from contaminating other nearby nozzles with a different color of ink.

If a uni-directional absorbent is not commercially available, it is possible to make a simple, two-dimensional one without much difficulty. This involves stacking thin layers of absorbent material with an impervious material like plastic sheeting, applying your adhesive membrane to one end, and slicing off a thin pad, as illustrated in FIG. 1 by the arrow 7 showing the direction of slicing.

Figure 2:
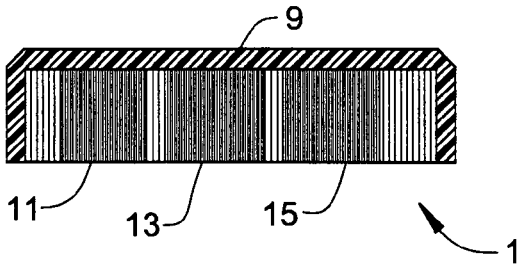
FIG. 2 illustrates a seal having three different colors held separated.

The thickness of the absorbent and impervious layers would be such that several layers would be needed to span between nozzle arrays of different colors. This way only one or two absorbent layers would contact a given nozzle array, and avoid cross-contamination. FIG. 2 is a cross-sectional view of a pad 1, having an outer support layer or membrane 9 and showing three colors (typically magenta 11, cyan 13, and yellow 15) inks absorbed, but separated by the barrier layers 5.

A top layer 9 may be constructed of moisture permeable materials such as plastic films, fabrics, or mechanical structures, or may be constructed of moisture impermeable materials such as plastic films, treated fabrics or mechanical structures, or may be constructed of gas impermeable materials, or any combination of the above. As with respect to the barrier layers 3, the objective of the top layer 9 is to confine any ink that escapes the nozzles to the nozzle area. It may be further desirable to have a complete seal including an airtight seal to prevent the ink from drying out and occluding the nozzles.

A usual concern with an absorbent would be that it would swell, soften or deform and clog the nozzle orifices. However, the capillary wall structure of pad 1 serves to keep the absorbent material 3 away from the nozzle plate, and supports the absorbent. Nevertheless, the absorbent regions 3 at their surfaces contacting the nozzle plate can be modified somewhat physically to avoid entry into the orifices while still absorbing ink.

Figure 3:
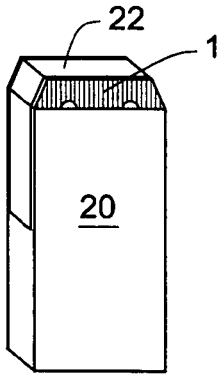
FIG. 3 is illustrative of an embodiment of this invention employing a tape and absorbent element.

FIG. 3 shows an implementation of this invention with an illustrative inkjet cartridge containing ink for inkjet printing. The cartridge 20 has it orifices sealed for storage and handling by a pad 1 as described, which is supported and held to the cartridge by an adhesive tape 22 (a common film layer tape) which spans the pad and extends down sides of the cartridge and attaches by its adhesive to the surface of the cartridge. Typically, pad 1 will be previously attached to the tape 22 by adhesive and the two brought to the cartridge 20 as a unit.

A wide range of alternatives can be anticipated consistent with the absorbent material being compartmentalized by barriers preventing movement of the ink across the barriers. The absorbent pad could be presaturated with pigmentless ink solution, presaturated with a hydrophobic or hydrophilic solution immiscible with the ink (i.e. hydrophobic when the ink is aqueous), or the pad is just allowed to saturate with ink. The objective is to keep the nozzles moist but not move ink between them. With a pigmented ink, it may be possible to have localized flocculation of the pigment in the absorbent and so keep the colors from migrating.

What is claimed is:

1. An inkjet ink container holding ink having orifices for jetting said ink for printing comprising a seal held in contact with said orifices, said seal having extending from said orifices alternating regions of substantially uni-axial ink absorbent material separated by material which is a barrier to movement of said ink; wherein said seal is held against said orifices by a film layer tape attached by adhesive to a surface of said container.

2. The ink container comprising a seal as in claim 1 in which said seal covers all orifices for jetting said ink for printing and said barrier to movement of said ink is internal to said seal and also surrounds all said orifices covered by said seal.

3. The ink container comprising a seal as in claim 2 in which said barrier material surrounds orifices for jetting ink of a first color and surrounds orifices for jetting ink of a second color whereby said barrier material blocks mixing of colors in said seal.

4. The ink container of claim 3 in which said first color is one of magenta, cyan, and yellow and said second color is another of magenta, cyan, and yellow.

5. An inkjet ink container holding ink having orifices for jetting said ink for printing comprising a seal held in contact with said orifices by a film layer tape attached by adhesive to a surface of said container, said seal having extending from said orifices alternating regions of ink absorbent material separated by material which is a barrier to substantially lateral movement of said ink.

6. The ink container comprising a seal as in claim 5 in which said seal covers all orifices for jetting said ink for printing and said barrier to movement of said ink is internal to said seal and also surrounds all said orifices covered by said seal.

7. The ink container comprising a seal as in claim 6 in which said barrier material surrounds orifices for jetting ink of a first color and surrounds orifices for jetting ink of a second color whereby said barrier material blocks mixing of colors in said seal.

8. The ink container of claim 7 in which said first color is one of magenta, cyan, and yellow and said second color is another of magenta, cyan, and yellow.

* * * * *